US006521177B1

(12) United States Patent
Fellows

(10) Patent No.: US 6,521,177 B1
(45) Date of Patent: Feb. 18, 2003

(54) PROCESS FOR COMPOUNDING TITANIUM ALLOYS

(75) Inventor: Steve Fellows, Canton, OH (US)

(73) Assignee: Galt Alloys, Inc., Canton, OH (US)

( * ) Notice: Subject to any disclaimer, the term of this patent is extended or adjusted under 35 U.S.C. 154(b) by 0 days.

(21) Appl. No.: 09/537,378

(22) Filed: Mar. 29, 2000

(51) Int. Cl.[7] ..... C22C 1/00
(52) U.S. Cl. ..... 420/590; 266/287; 75/255
(58) Field of Search ..... 420/590; 266/287; 366/348; 75/255, 246

(56) References Cited

U.S. PATENT DOCUMENTS

| | | | | | |
|---|---|---|---|---|---|
| 2,792,621 | A | | 5/1957 | Howell | 29/184 |
| 3,036,910 | A | | 5/1962 | Eichenberger | 75/44 |
| 3,785,784 | A | | 1/1974 | Tezuka | 29/186 |
| 3,807,986 | A | | 4/1974 | Funk et al. | 75/11 |
| 3,933,340 | A | * | 1/1976 | Krull | 366/348 |
| 4,062,677 | A | * | 12/1977 | Perfect | 75/255 |
| 4,103,610 | A | | 8/1978 | Vezzani | 100/232 |
| 4,428,679 | A | * | 1/1984 | Fischer et al. | 366/348 |
| 4,799,426 | A | | 1/1989 | Geremia | 100/218 |
| 4,815,371 | A | | 3/1989 | Geremia | 100/35 |
| 5,897,962 | A | * | 4/1999 | Houck et al. | 75/246 |

* cited by examiner

*Primary Examiner*—Scott Kastler
(74) *Attorney, Agent, or Firm*—Sand & Sebolt

(57) ABSTRACT

A method for compounding an alloy includes the step of forming a first batch of the base metal and tracking the first batch through the process. The master alloy is added to the first batch based on the weight of the base metal. In one embodiment, the master alloy is added to meet a desired percentage. In another embodiment, the master alloy is added to meet a desired total weight. When the total weight criteria is used, a computer tracks the weights of the batches and compensates for heavy batches with light batches and compensates for light batches with heavy batches in order to maintain the average weight of the batches at the desired total weight. The batches are briquetted and the composition of the briquettes are tracked. The briquettes are added to an electrode formation device and the position of the briquettes in the device is tracked so that the composition of the electrode can be identified.

29 Claims, 1 Drawing Sheet

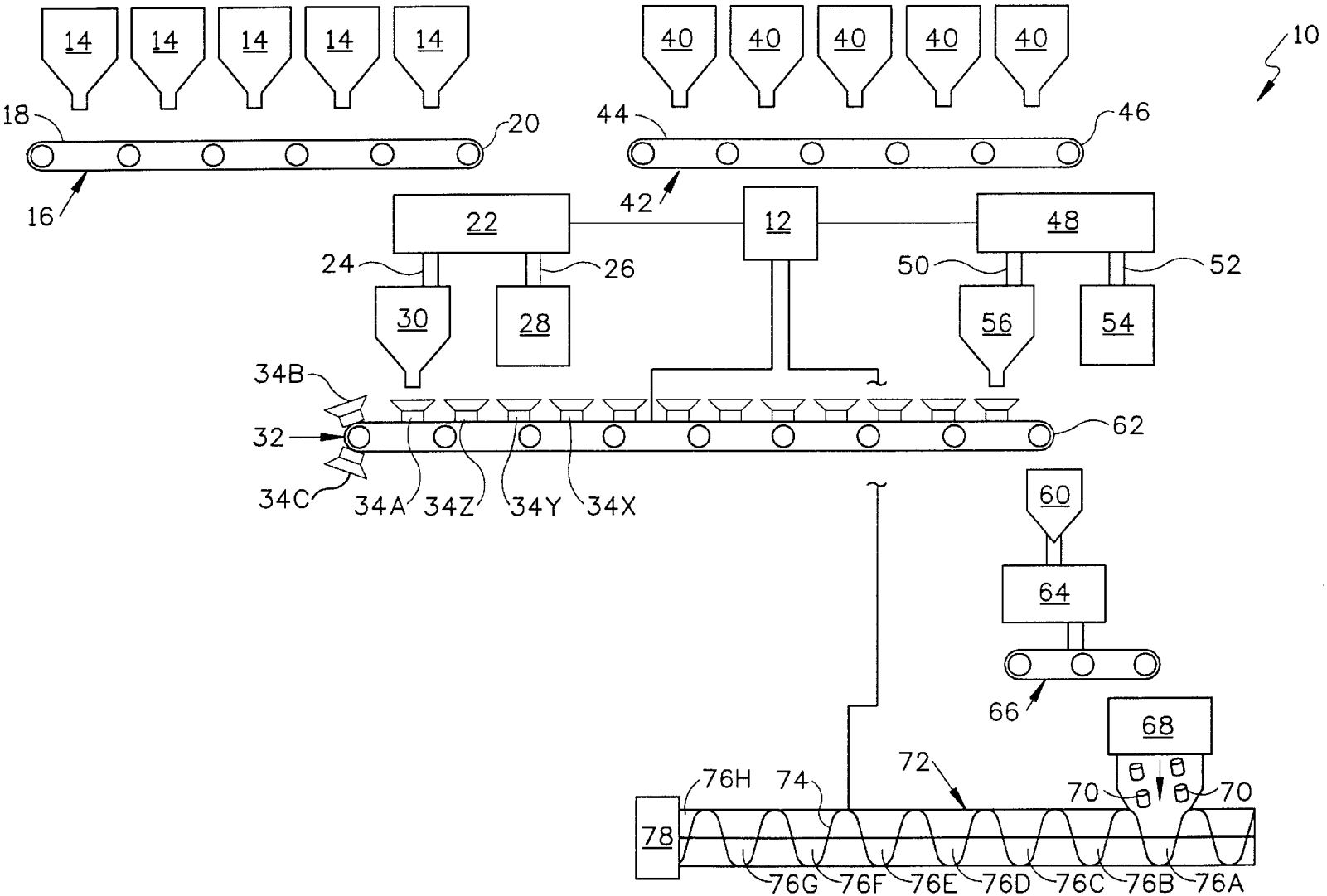
10
14
14
14
14
14
18
16
20
22
24
26
28
30
12
40
40
40
40
40
44
42
46
48
50
52
54
56
62
34B
32
34C
34A
34Z
34Y
34X
60
64
66
68
70
70
72
74
76H
76G
76F
76E
76D
76C
76B
76A
78

PROCESS FOR COMPOUNDING TITANIUM ALLOYS

BACKGROUND OF THE INVENTION

1. Technical Field

The present invention generally relates to methods for compounding alloys and, more particularly, to a process that divides a large batch of alloy materials into a plurality of accurately-measured smaller batches that each have the proper percentages of alloy materials in order to control and track the percentages of materials throughout the process of compounding the materials. The weight of small titanium batches are tracked by a computer that subsequently controls the addition of master alloy material to compensate for different amounts of titanium in the batches. The small mixed batches of titanium and master alloy are then briquetted and used to form an electrode ingots, slabs, pucks, or any manufactured near net shaped or net shaped products.

2. Background Information

Titanium alloy is currently produced by dividing a large amount of titanium material and master alloy material into a plurality of small batches that are briquetted and formed into an electrode. For instance, a 3000 pound batch of titanium and master alloy components may be processed in ten 300 pound batches. Although the 3000 pound batch included the proper percentages of materials, the percentages of materials in the 300 pound batches may be significantly different than the desired mixture of materials. When the mixture is off, the resulting electrode will include portions that have too much titanium and other portions that include too much master alloy. Forming electrodes in this way is undesirable because of the varying percentages of materials. The art thus desires a method of forming a titanium alloy electrode wherein the mixture of titanium and master alloy is tightly controlled to provide a uniform electrode.

SUMMARY OF THE INVENTION

In view of the foregoing, it is an objective of the present invention to provide a method for processing titanium alloys that mixes the alloy components in small batches.

Another objective of the present invention is to provide a method of processing titanium alloy that ensures each small batch of alloy materials has substantially the same composition of materials as all of the other small batches.

Another objective of the present invention is to provide a method of processing titanium alloy that ensures accurate compositions while enabling components to be reused if measured inaccurately.

Another objective of the invention is to provide a method of processing titanium alloy wherein the content of a series of small batches is tracked so that the contents of subsequent batches may compensate for earlier batches to maintain the overall consistency of the resulting electrode.

Another objective of the invention is to provide a method for processing an alloy having at least two components that must be mixed by a given percentage wherein the weight of the first material is measured and the second material is then added based on the weight of the first material and the given percentage.

Another objective of the present invention is to provide a method for processing an alloy whereby the contents of the alloy are divided into small batches and tracked throughout the entire process of mixing the components to forming an electrode.

These and other objectives and advantages ofthe invention are achieved by a method for compounding a base metal with a master alloy comprising the steps of: (a) providing a quantity of the base metal; (b) providing a quantity of the master alloy; (c) creating a first batch of the base metal; (d) identifying the weight of the first batch of base metal; (e) adding master alloy to the first batch of base metal to form a mixture batch; and (f) basing the weight of the master alloy added to the first batch of base metal on the weight of the first batch of base metal.

Other objectives and advantages of the invention are achieved by a method for compounding a base metal with a master alloy comprising the steps of: (a) providing a quantity of the base metal; (b) providing a quantity of the master alloy; (c) creating a first batch of the base metal; (d) identifying the weight of the first batch of base metal; (e) adding master alloy to the first batch of base metal to form a mixture batch; (f) creating a second batch of the base metal; and (g) basing the weight of the base metal in the second batch on the weight of the base metal in the first batch.

Further objectives and advantages of the invention are achieved by an apparatus for compounding a base metal with a master alloy; the apparatus comprising: a scale; a supply of base metal adapted to deliver base metal to the scale; a supply of master alloy adapted to deliver master alloy to the scale; a computer in communication with the scale; a computer adapted to identify the weight of material in the scale and store the weight in its memory; and a mixing conveyor adapted to selectively receive material from the scale.

BRIEF DESCRIPTION OF THE DRAWINGS

The preferred embodiment of the invention, illustrative of the best mode in which applicant has contemplated applying the principles of the invention, is set forth in the following description and is shown in the drawing and is particularly and distinctly pointed out and set forth in the appended claims.

The drawing FIGURE is an overall schematic view of the processing line for accomplishing the method of the present invention.

Similar numbers refer to similar elements throughout the specification.

DESCRIPTION OF THE PREFERRED EMBODIMENTS

The method of the present invention is achieved by the processing line indicated by the numeral 10 in the accompanying drawings. The method of the present invention allows titanium alloy materials to be mixed in small batches while controlling the components ofthe small batches. To maintain consistency, the method of the present invention will base the contents of each small batch based on the contents of the immediately-preceding batch or a summary of proceeding batches. The small batches are tracked by a computer 12 so that the percentages of materials in the resulting electrode can be identified.

In the preferred embodiment of the invention, five base metal hoppers 14 are provided to initially hold the base metal to be alloyed. In the exemplary embodiment, the metal is titanium. The titanium may be in any of a variety of known forms when it resides in hoppers 14. For example, the titanium may be a plurality of titanium chips or titanium sponge.

Hoppers 14 are positioned above a conveyor mechanism 16. In the preferred embodiment of the invention, conveyor mechanism 16 is a vibratory feeder configured to slowly move material deposited on its upper surface 18 off of its feed end 20. Other types of conveyor mechanism 16 may be used in alternative embodiments of the invention.

Feed end 20 of conveyor mechanism 16 is positioned above the inlet of a scale 22 that includes a conveyor outlet 24 and a reuse outlet 26. Scale 22 is in communication with computer 12 so that computer 12 can identify and store the weight of the titanium material disposed in scale 22. Computer 12 also assigns a batch number to the material in scale 22 so that the material may be tracked throughout the process.

If computer 12 determines that the weight of the material in scale 22 exceeds a limit set by the user of the method, computer 12 causes scale 22 to empty its contents through reuse outlet 26. In the preferred embodiment, reuse outlet 26 empties into a reuse hopper 28. Reuse hopper 28 may be periodically emptied back into hoppers 14 or may be continuously connected to hoppers 14 by a conveyor that automatically empties hopper 28 back into hoppers 14.

When computer 12 determines that the weight of the material in scale 22 is in an acceptable range, computer 12 causes scale 22 to empty its contents through conveyor outlet 24 into a holding hopper 30. Holding hopper 30 is positioned above a mixing conveyor 32 that includes a plurality of buckets 34. In the preferred embodiment of the invention, buckets 34 are identified as buckets 34A through 34Z so that computer 12 may identify and track buckets 34 as they move along conveyor 32. Buckets 34 may be identified by any of a variety of identifying indicia as known in the art.

Processing line 10 further includes a plurality of master alloy hoppers 40. In the preferred embodiment of the invention, five master alloy hoppers 40 are provided to initially hold the master alloy to be mixed with the metal from hoppers 14. In the exemplary embodiment, the master alloy is one of vanadium aluminum, aluminum molybdenum, aluminum zirconium sponge, or a variety of other known master alloys.

Hoppers 40 are positioned above a conveyor mechanism 42. In the preferred embodiment of the invention, conveyor mechanism 42 is a vibratory feeder configured to slowly move material deposited on its upper surface 44 off of its feed end 46. Other types of conveyor mechanism 42 may be used in alternative embodiments of the invention.

Feed end 46 of conveyor mechanism 42 is positioned above the inlet of a scale 48 that includes a conveyor outlet 50 and a reuse outlet 52. Scale 48 is in communication with computer 12 so that computer 12 can identify and store the weight of the master alloy disposed in scale 22. Computer 12 also assigns a batch number to the material in scale 48 so that the material may be tracked throughout the process.

If computer 12 determines that the weight of the material in scale 48 exceeds a determined value, computer 12 causes scale 48 to empty its contents through reuse outlet 52. In the preferred embodiment, reuse outlet 52 empties into a reuse hopper 54. Reuse hopper 54 may be periodically emptied back into hoppers 40 or may be continuously connected to hoppers 40 by a conveyor that automatically empties hopper 54 back into hoppers 40.

When computer 12 determines that the weight of the material in scale 48 is in an acceptable range, computer 12 causes scale 48 to empty its contents through conveyor outlet 50 into a holding hopper 56. Holding hopper 56 is positioned above mixing conveyor 32.

In another embodiment of the invention, scale 22 may be used to measure both materials. In this embodiment, conveyor mechanisms 16 and 42 are controlled to stop placing material in scale 22 while the other conveyor is moving.

Processing line 10 further includes a collection hopper 60 positioned below the end 62 of mixing conveyor 32. Collection hopper 60 empties into a mixer 64 that throughly mixes the titanium with the master alloy. Mixer 64 may be a rotary-type mixer or another suitable mixer as is known in the art. The outlet of mixer 64 is positioned to empty the contents of mixer 64 onto a conveyor 66 that moves the mixed materials into a briquetter 68.

Briquetter 68 forms pucks 70 that are fed into a rotary screw drum 72 that feeds a device 78 that forms a consumable electrode out of pucks 70. Computer 12 is in communication with rotary screw drum 72 so that computer 12 can track the position of the screw 74. Computer 12 may thus identify the individual flights 76A–76F within screw drum 72 and track the position of pucks 70 within screw drum 72.

Having now described the components of the present invention, the method performed by processing line will now be described. In accordance with the objectives of the present invention, the method allows the consistency of the titanium and master alloy to be tightly controlled throughout the process so that the resulting consumable electrode has a consistent and identifiable composition.

The method starts at hoppers 14 where titanium is deposited onto conveyor 16. Conveyor 16 slowly moves the titanium into scale 22 where computer 12 continuously (or periodically) weighs the contents of scale 22. The user of the method defines the desired amount of titanium for each bucket 34. For instance, the user may desire that each bucket 34 includes ten pounds of titanium. In this example, computer 12 continues to weigh the material in scale 22 until the weight reaches ten pounds. If ten pounds is not exactly reached, computer 12 compares the actual weight against an acceptable range to determine if the material in scale should be emptied into holding hopper 30. If the range is exceeded, computer 12 directs the material in scale 22 into reuse hopper 28.

When computer 12 empties the material in scale 22 into holding hopper 30, computer 12 stores the exact weight of the batch in a manner that allows the weight to be readily identified. Holding hopper 30 holds the material until conveyor 32 positions an empty bucket 34 below hopper 30. Hopper 30 then empties the material into bucket 34. In this example, the bucket holding this material shall be referred to as bucket 34A. Computer 12 then matches the identifying indicia of bucket 34A with the weight recorded for the material emptied into bucket 34A.

Once bucket 34A is filled, conveyor 32 advances and the process of filling scale 22 and the next successive bucket 34Z is repeated. Conveyor 32 then advances until bucket 34A is positioned to receive the master alloy from holding hopper 56. In the embodiment of the invention using one scale, bucket 34A remains in place until loaded with master alloy.

The process of weighing the master alloy is essentially the same as the process of weighing the titanium except that the target weight is based on the weight of the batch of titanium in the target bucket. The mixing methodology must be selected by the user. The mixing methodology may require that each bucket 34 includes a target percentage of materials or that each bucket meets a target weight. In the first embodiment, the user may desire that each bucket includes 75 percent (by weight) master alloy and 25 percent (by weight) titanium without regard to the total weight of material in the bucket. In the other embodiment, the total weight of material in the bucket must equal a target weight (such as forty pounds) without regard to the percentages of materials. It is understood that essentially any percentage or any target weight may be used instead of these examples.

For example, the first mixing methodology requires computer 12 to base the target weight in scale 48 using the percentage method based on the weight of the base metal in bucket 34A. If bucket 34A has 9.5 pounds of titanium, computer 12 loads 28.5 pounds of master alloy into scale 48 before emptying into holding hopper 56. The 9.5/28.5 mixture results in the target percentage. The method then continues by basing the next batch weight of base metal without any reference to the total weight of the previous batch.

In another embodiment, computer 12 records the total weight of the batch in bucket 34A and compensates for the weight in the next successive batch or successive batches. For example, batch 34A was thirty-eight pounds based on the percentage method. If the target weight for each batch is forty pounds, computer 12 measures the titanium for the next successive batch to be 10.5 pounds so that the master alloy will be 31.5 pounds causing the total batch weight to be forty-two pounds. The combination of batches 34A and 34B thus totaling eighty pounds. If the weight in bucket 34B does not result in a perfect compensation to the target, computer 12 continues the compensation with bucket 34C, and so on.

In the other mixing methodology, computer 12 only bases the weight of batches in buckets 34A–34Z by a total target weight without measuring the percentage. In the above example, batch 34A included 9.5 pounds of titanium. In this embodiment, computer 12 would then add 30.5 pounds of master alloy into bucket 34A to make the total weight of bucket 34A equal forty pounds. If the exact target weight is not achieved, computer 12 compensates by adding more weight or subtracting weight in the next successive bucket 34B. For example, if bucket 34A has 40.3 pounds of material, computer 12 loads bucket 34B with 39.7 pounds of material. Again, if exact compensation cannot be achieved, computer 12 continues to compensate with the next successive bucket. In this methodology, computer 12 may also track the weights of base metal and master alloy so that a target percentage may also be met.

Another method for mixing the base metal and master alloy involves the step of defining a target weight of the base metal for each batch and determining the weight of a batch of base metal based on the weight of the base metal in a previous batch and the target weight. In this embodiment, the method does not involve the use of a target weight ratio. Specifically, the weight of the base metal in the first batch is compared to the target weight. The difference between the target weight and the weight of the base metal in the first batch is compensated for in the weight of the base metal added to the second batch so that the average of the weight of the base metal in the first and second batches is substantially equal to the target weight. The process can be repeated such that, for instance, a third batch of the base metal can be created where the weight of the base metal in the third batch is based on the weight of the base metal in the second batch and the target weight.

And yet another mixing methodology, an average error over the previous four batches is taken such that the target weight is adjusted by a small percentage based on the weight of each of the last four batches. In this manner, a tight target weight tolerance is followed similar to the percentage weight variance set forth above.

Buckets 34 are emptied into mixer 64 and mixed. Mixed batches are briquetted to form pucks 70 which are fed into a flight 76 of screw 74. The batch from bucket 34A is thus fed into flight 76A which is also tracked by computer 12. Computer 12 can thus identify the specific composition of the consumable electrode after the electrode is formed. Computer 12 can thus identify areas of the electrode where a higher percentage of titanium resides.

Accordingly, the improved method for compounding titanium is simplified, provides an effective, safe, inexpensive, and efficient device and method which achieves all the enumerated objectives, provides for eliminating difficulties encountered with prior devices and methods, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and Are intended to be broadly construed.

Moreover, the description and illustration of the invention is by way of example, and the scope of the invention is not limited to the exact details shown or described.

Having now described the features, discoveries, and principles of the invention, the manner in which the method and apparatus is constructed and used, the characteristics of the construction, and the advantageous new and useful results obtained; the new and useful structures, devices, elements, arrangements, parts, and combinations are set forth in the appended claims.

What is claimed is:

1. A method for compounding a base metal with a master alloy comprising the steps of:

(a) providing a first quantity of the base metal;

(b) providing a first quantity of the master alloy;

(c) creating a first batch of the base metal; the first batch of base metal only including a portion of the first quantity of the base metal;

(d) identifying the weight of the first batch of base metal;

(e) identifying a target weight ratio of base metal to master alloy;

(f) adding a first portion of master alloy to the first batch of the base metal to form a first mixture batch; the first portion having a weight determined by applying the target weight ratio to the weight of the first batch of base metal;

(g) forming a portion of a first electrode with the first mixture batch; and (h) identifying the location of the first mixture batch within the electrode;

(i) creating a second batch of the base metal; the second batch of base metal only including a portion of the first quantity of the base metal;

(j) identifying the weight of the second batch of base metal;

(k) adding a second portion of master alloy to the second batch of the base metal to form a second mixture batch; the second portion having a weight determined by applying the target weight ratio to the weight of the second batch of base metal;

(l) forming a portion of the first electrode with the second mixture batch; and (m) identifying the location of the second mixture batch within the electrode.

2. The method of claim 1, further comprising the steps of providing a computer and tracking the location of the each batch of base metal with the computer.

3. The method of claim 2, further comprising the steps of providing an electrode formation device, moving the mixture batches into the electrode formation device, and tracking the location of the mixture batches into the electrode formation device with the computer.

4. The method of claim 1, further comprising the steps of identifying the weight of the second mixture batch, defining a desired target batch weight; calculating a target weight for a third mixture batch, the third target weight being equal to the target batch weight added to the difference between the weight of the second mixture batch and the target batch weight; and forming a third mixture batch of base metal and master alloy having the target weight.

5. The method of claim 1, further comprising the steps of identifying a target weight for the base metal in a mixture batch and forming a third batch of base metal having a weight; the weight of the third batch of base metal being equal to the target weight added to the difference between the weight of the base metal in the second batch and the target weight.

6. The method of claim 1, further comprising the steps of defining a target batch weight, and creating a third mixture batch having a weight; the average weight of the second and third batches being substantially equal to the target batch weight.

7. The method of claim 1, further comprising the steps of:

identifying a target weight for the batches of base metal;

rejecting a batch of base metal if its identified weight exceeds the target weight.

8. The method of claim 7, further comprising the step of reusing the rejected batch of base metal.

9. An apparatus for compounding a base metal with a master alloy and forming an electrode with the compound; the apparatus comprising:

a first scale;

a supply of base metal adapted to deliver base metal to the first scale;

a second scale;

a supply of master alloy adapted to deliver master alloy to the second scale;

a computer in communication with the first and second scales;

the computer being adapted to identify the weight of the material in the scale and to store and track the weight;

a mixing conveyor adapted to be moved between a plurality of positions;

the mixing conveyor having a plurality of distinct containers;

the distinct containers of the mixing conveyor adapted to selectively receive material from the first and second scales;

the computer being adapted to track the position of the mixing conveyor;

a mixer adapted to receive material from the mixing conveyor; and an electrode formation device adapted to receive material from the mixer.

10. The apparatus of claim 9, wherein the mixing conveyor is adapted to receive distinguishable batches; the computer adapted to identify and track the batches on the mixing conveyor.

11. The apparatus of claim 9, further comprising means for controlling the weight of material delivered to the mixing conveyor.

12. The apparatus of claim 9, wherein the scale includes a first outlet and a second outlet; the first outlet adapted to deliver material to the mixing conveyor; and the second outlet in communication with means for recycling the material received from the second outlet.

13. The apparatus of claim 9, further comprising a briquetter adapted to receive material from the mixer; and an electrode formation device adapted to receive material from the briquetter.

14. The apparatus of claim 13, wherein the electrode formation device is in communication with the computer; the computer being adapted to track the location of batches of material along the mixing conveyor and the electrode formation device.

15. A method for compounding a base metal with a master alloy and forming an electrode from the compound; the method comprising the steps of:

(a) providing a first quantity of the base metal;

(b) providing a first quantity of the master alloy;

(c) creating a first batch of the base metal with a portion of the first quantity of the base metal;

(d) identifying the weight of the first batch of base metal;

(e) identifying a target weight ratio of base metal to master alloy and identifying a target weight for each batch of the base metal;

(f) adding a first portion of master alloy to the first batch of the base metal to form a first mixture batch; the first portion of master alloy having a weight determined by applying the target weight ratio with the weight of the first batch of base metal;

(g) forming a portion of an electrode with the first mixture batch;

(h) identifying the location of the first mixture batch within the electrode;

(i) comparing the weight of the base metal in the first batch to the target weight to obtain a weight difference;

(j) creating a second batch of the base metal with a portion of the first quantity of the base metal; the weight of the base metal in the second batch of base metal being equal to the target weight added to the weight difference;

(k) adding a second portion of master alloy to the second batch of the base metal to form a second mixture batch; the second portion of master alloy having a weight determined by applying the target weight ratio with the weight of the second batch of base metal;

(g) forming a portion of an electrode with the second mixture batch; and (h) identifying the location of the second mixture batch within the electrode.

16. A method for compounding a base metal with a master alloy comprising the steps of:

(a) providing a first quantity of the base metal;

(b) providing a first quantity of the master alloy;

(c) creating a first batch of the base metal; the first batch of base metal only including a portion of the first quantity of the base metal;

(d) identifying the weight of the first batch of base metal;

(e) adding master alloy to the first batch of base metal to form a mixture batch;

(f) identifying a target weight for the base metal in a mixture batch;

(g) creating a second batch of the base metal with a second portion of the first quantity of the base metal;

(h) comparing the weight of the base metal in the first batch to the target weight and compensating for the difference between the target weight and the weight of the base metal in the first batch in the weight of the base metal added to the second batch so that the average of the weight of the base metal in the first and second batches is substantially equal to the target weight;

(i) adding master alloy to the second batch of base metal to form a second mixture batch;

(j) forming at least a portion of an electrode with the mixture batches;

(k) identifying the location of each mixture batch within the electrode; and (l) creating a third batch of the base metal; and defining the weight of the base metal in the third batch with the weight of the base metal in the second batch and the target weight.

17. A method for compounding a base metal with a master alloy comprising the steps of:

(a) providing a first quantity of the base metal;

(b) providing a first quantity of the master alloy;

(c) creating a first batch of the base metal; the first batch of base metal only including a portion of the first quantity of the base metal;

(d) identifying the weight of the first batch of base metal;

(e) adding master alloy to the first batch of base metal to form a mixture batch;

(f) creating a second batch of the base metal with a second portion of the first quantity of the base metal;

(g) identifying the weight of the second batch of base metal;

(h) adding master alloy to the second batch of base metal to form a second mixture batch;

(i) creating a third batch of the base metal with a third portion of the first quantity of the base metal;

(j) identifying the weight of the third batch of base metal;

(k) adding master alloy to the third batch of base metal to form a third mixture batch;

(l) creating a fourth batch of the base metal with a fourth portion of the first quantity of the base metal;

(m) identifying the weight of the fourth batch of base metal;

(n) adding master alloy to the fourth batch of base metal to form a fourth mixture batch;

(o) identifying a target weight for the base metal in a mixture batch;

(p) calculating an average error over the four batches; and adjusting the target weight based on the weight of each of the last four batches;

(q) forming at least a portion of an electrode with the mixture batches; and (r) identifying the location of each mixture batch within the electrode.

18. The method of claim 15, further comprising the steps of providing a computer and tracking the location of the each batch of base metal with the computer.

19. The method of claim 18, further comprising the steps of:

providing an electrode formation device;

moving the mixture batches into the electrode formation device; and tracking the location of the mixture batches into the electrode formation device with the computer.

20. The method of claim 15, further comprising the steps of:

identifying the weight of the second batch of base metal; and rejecting a batch of base metal if its identified weight exceeds the target weight.

21. The method of claim 20, further comprising the step of reusing the rejected batch of base metal.

22. The method of claim 16, further comprising the steps of providing a computer and tracking the location of the each batch of base metal with the computer.

23. The method of claim 22, further comprising the steps of:

providing an electrode formation device;

moving the mixture batches into the electrode formation device; and tracking the location of the mixture batches into the electrode formation device with the computer.

24. The method of claim 16, further comprising the step of rejecting a batch of base metal if its identified weight exceeds the target weight.

25. The method of claim 24, further comprising the step of reusing the rejected batch of base metal.

26. The method of claim 17, further comprising the steps of providing a computer and tracking the location of the each batch of base metal with the computer.

27. The method of claim 26, further comprising the steps of:

providing an electrode formation device;

moving the mixture batches into the electrode formation device; and tracking the location of the mixture batches into the electrode formation device with the computer.

28. The method of claim 17, further comprising the step of rejecting a batch of base metal if its identified weight exceeds the target weight.

29. The method of claim 28, further comprising the step of reusing the rejected batch of base metal.

* * * * *